US007077119B1

(12) United States Patent
Dube, Sr. et al.

(10) Patent No.: US 7,077,119 B1
(45) Date of Patent: Jul. 18, 2006

(54) QUIVER LOCK ASSEMBLY FOR ARROWS AND BOLTS

(76) Inventors: John J. Dube, Sr., 213 Delaware St., Bloomsburg, PA (US) 17815; Connie L. Young, 199 Summit Ave., Bloomsburg, PA (US) 17815

( * ) Notice: Subject to any disclaimer, the term of this patent is extended or adjusted under 35 U.S.C. 154(b) by 0 days.

(21) Appl. No.: 11/036,793

(22) Filed: Jan. 18, 2005

(51) Int. Cl.
*F41B 5/06* (2006.01)

(52) U.S. Cl. ..... 124/86; 124/25.5

(58) Field of Classification Search ..... 124/25.5, 124/25.7, 86, 88; 224/916
See application file for complete search history.

(56) References Cited

U.S. PATENT DOCUMENTS

| | | | | |
|---|---|---|---|---|
| 2,986,187 | A | 5/1961 | Gazzara | |
| 3,591,062 | A | 7/1971 | Karbo | |
| 3,777,734 | A | 12/1973 | Rose | |
| 4,607,606 | A | 8/1986 | Schaar | |
| D328,772 | S | 8/1992 | Bowton | |
| 5,190,022 | A | 3/1993 | Larson | |
| 5,265,584 | A * | 11/1993 | Judson et al. | 124/86 |
| 5,775,313 | A * | 7/1998 | Bresette et al. | 124/86 |
| 6,105,566 | A | 8/2000 | Tiedemann | |
| 6,691,694 | B1 * | 2/2004 | Stinson | 124/86 |

* cited by examiner

*Primary Examiner*—John A. Ricci

(57) ABSTRACT

A quiver lock assembly includes a quiver lock including a base section that has a rectilinear shape and oppositely disposed end portions laterally spaced from a support member of the bow. The base section is aligned subjacent to the central support member and is provided with juxtaposed recessed notches spaced along the longitudinal length thereof. The recessed notches are sized and shaped for receiving and maintaining the projectiles. The assembly further includes articulated locking arms pivotally connected to the base section. Each locking arm is provided with an arcuate inner edge engageable with the projectiles such that the user may bias one of the locking arms and remove one of the projectiles. The locking arms are formed from non-skid rubber material for maintaining effective contact with the projectiles and are positioned distal to the base section for assisting the user to manipulate the locking arms between open and locked positions.

18 Claims, 2 Drawing Sheets

QUIVER LOCK ASSEMBLY FOR ARROWS AND BOLTS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to quiver locks and, more particularly, to a quiver lock assembly for affixing projectiles to a bow.

2. Prior Art

A convenient location to carry a quiver of arrows or bolts is on the bow or cross-bow itself, respectively. Such a quiver location gives a user quick and convenient access to their arrows and bolts. Conventional bow/cross-bow mounted quivers that simply attach to the bow or cross-bow have various drawbacks and limitations.

First, the numerous accessories such as sites, stabilizers, as well as quivers themselves, all add weight to a bow. The heavier the bow, the more difficult it becomes to hold a steady aim. Thus, it becomes important have bow accessories, such as quivers, that are light weight and easy to maneuver.

Another problem is the difficulty in providing a bow-mounted quiver that adapts to the various shaft diameters of arrows and bolts. Standard diameters range from about 0.200 in. for carbon or graphite arrows to about 0.360 in. for wood arrows. With conventional quivers, the arrow shafts usually snap into a resilient arrow keeper located at the lower end of the quiver. Larger diameter shafts are often hard to snap in and out, while the narrower shafts tend to slip back out. Furthermore, the snap-in action of conventional arrow keepers creates an undesirable snapping noise as an arrow is inserted or removed. When a hunter attempts to take a second shot at an animal, the noise is often enough to scare the animal away.

Accordingly, a need remains for a quiver lock assembly for arrows and bolts in order to overcome the above-noted shortcomings. The present invention satisfies such a need by providing a quiver lock assembly that is convenient, safe and easy to use.

BRIEF SUMMARY OF THE INVENTION

In view of the foregoing background, it is therefore an object of the present invention to provide a quiver lock assembly for arrows and bolts. These and other objects, features, and advantages of the invention are provided by a bow-mountable assembly for assisting a user to maintain a plurality of projectiles at a fixed relationship with the bow during non-operating conditions. The present invention conveniently holds arrows and bolts in place during sporting activities, while still allowing a user to remove such arrows and bolts quickly and quietly. User safety is further increased by preventing injury possibly inflicted by a dropped arrow or bolt. In addition, the arrows and bolts are not lost or damaged due to dropping same, which further saves the user a considerable amount of time and money that is otherwise spent looking for and replacing lost arrows or bolts, respectively.

The assembly includes a quiver lock including an elongated base section that has a rectilinear shape and a centrally disposed longitudinal axis extending substantially orthogonal to a longitudinal length of the bow. Such a base section further has oppositely disposed end portions laterally spaced from a centrally situated support member of the bow. The base section is aligned subjacent to the central support member such that the user can advantageously maintain an unobstructed line of sight during operating conditions.

The base section is further provided with a plurality of juxtaposed recessed notches spaced along the longitudinal length thereof. Such recessed notches are sized and shaped for receiving and effectively maintaining the projectiles along a substantially linear path extending parallel to the central support member of the bow. Preferably, the recessed notches are generally U-shaped and define a lower arcuate surface such that the projectiles can maintain continuous surface area contact when positioned within the recessed notches respectively.

The assembly further includes a plurality of articulated locking arms having opposed end portions pivotally connected to the base section and freely movable along a plurality of arcuate paths defined about an associated perimeter of each of the recessed notches. Each locking arm is provided with an arcuate inner edge removably engageable with the projectiles such that the user may resiliently bias a selected one of the locking arms and independently remove an associated one of the projectiles while remaining ones of the locking arms and respective projectiles are maintained at a static position. Such locking arms are formed from non-skid rubber material for advantageously maintaining effective surface area contact with the projectiles during non-operating conditions. One end portion of each of the locking arms may define a finger having an enlarged diameter passing over an associated one of the recessed notches for advantageously assisting to maintain the projectiles at a substantially stable position during non-operating conditions.

The locking arms are positioned distal to the base section for conveniently assisting the user to effectively manipulate the locking arms between open and locked positions, while maintaining the bow at a cocked position. Each of the locking arms preferably includes a pin member securely passed therethrough and welded with the base section. A first set of the locking arms may be situated on a right side of the central support member and a second set of the locking arms may be situated on a left side of the central support member such that the first and second locking arm sets are equidistantly offset from the central support locking member. Preferably, such a first set of locking arms are pivotal along a counterclockwise position from a locked position and the second set of locking arms are pivotal along a clockwise position from a locked position associated therewith.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
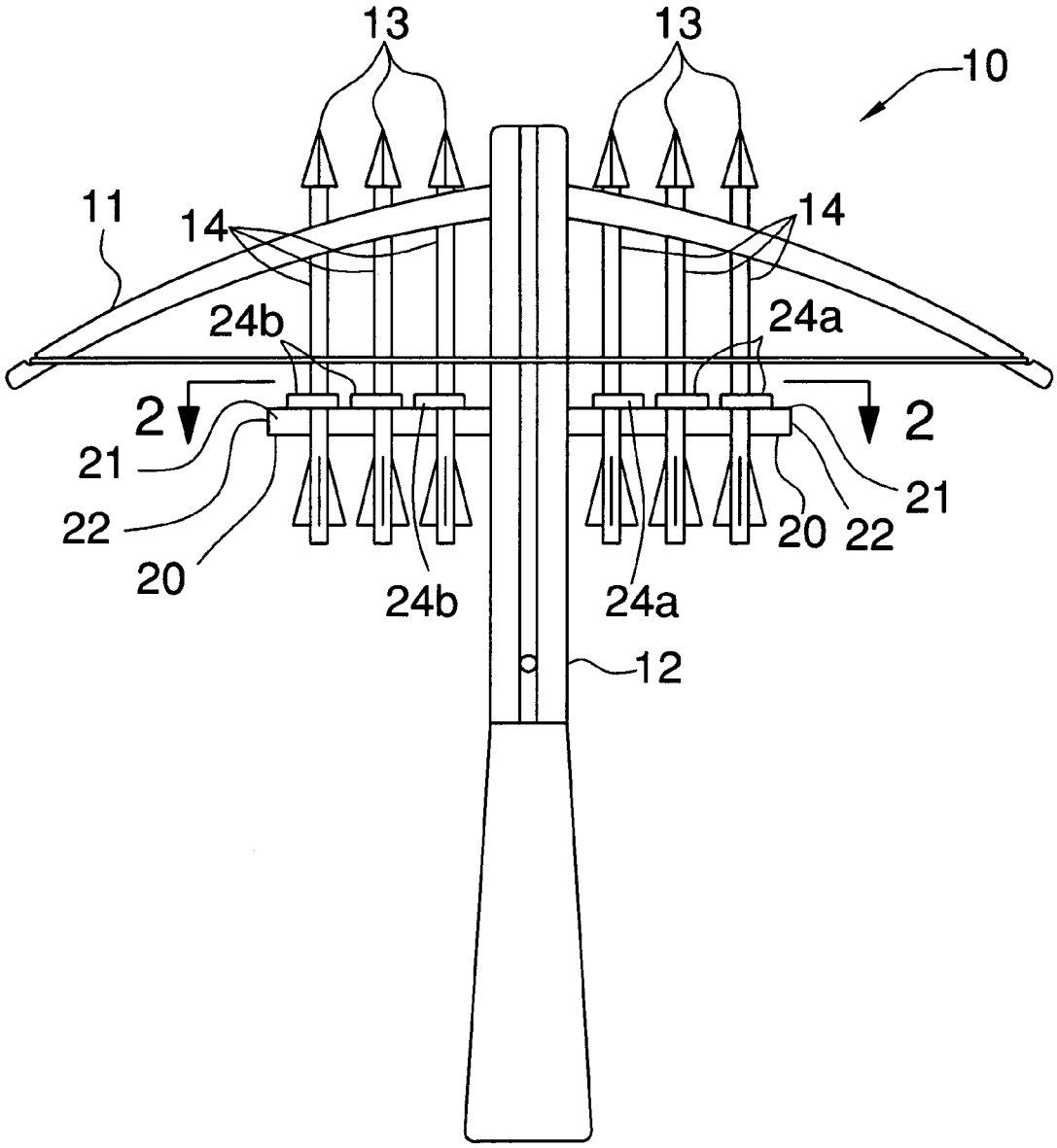
FIG. 1 is a top plan view showing a quiver lock assembly for arrows and bolts, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1–4 by the reference numeral 10 and is intended to provide a quiver lock assembly for arrows and bolts. It should be understood that the assembly 10 may be used to statically hold many different types of cross-bow bolts and bow arrows and should not be limited in use to only bolts and arrows of a single diameter.

Referring initially to FIG. 1, the assembly 10 includes a quiver lock 20 including an elongated base section 21 that has a rectilinear shape and a centrally disposed longitudinal axis extending substantially orthogonal to a longitudinal length of the bow 11. Such a base section 21 further has oppositely disposed end portions 22 laterally spaced from a centrally situated support member 12 of the bow 11. The base section 21 is aligned subjacent to the central support member 12 such that the user can advantageously maintain an unobstructed line of sight during operating conditions, thus improving their aim and subsequent successful target strike rate.

Figure 2:
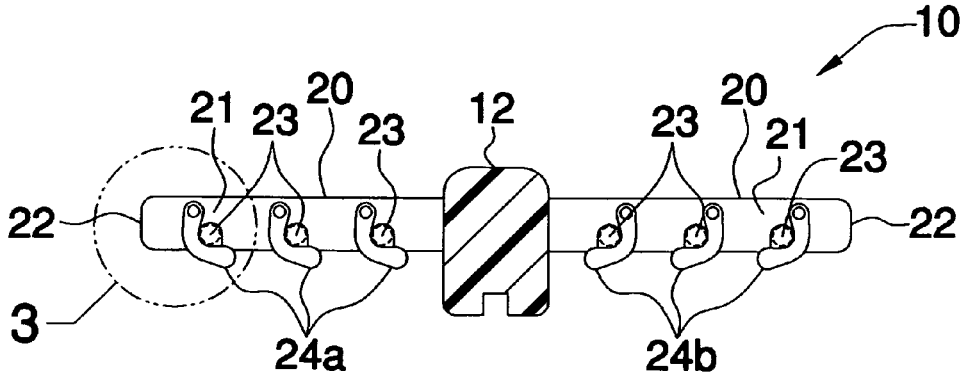
FIG. 2 is a front elevational view of the assembly shown in FIG. 1, taken along line 2—2.
Figure 3:
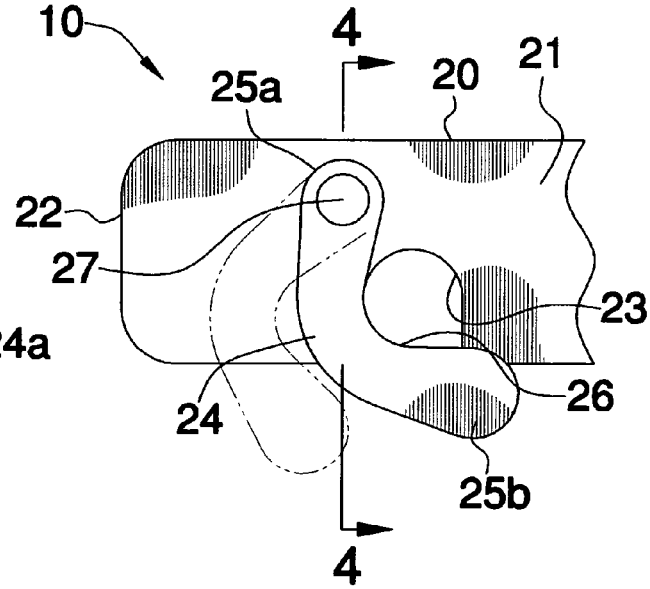
FIG. 3 is an enlarged view of section 3 shown in FIG. 2, showing the pivotal movement of the locking arms.

Referring to FIGS. 2 and 3, the base section 21 is further provided with a plurality of juxtaposed recessed notches 23 spaced along the longitudinal length thereof. Such recessed notches 23 are sized and shaped for receiving and effectively maintaining the projectiles 13 along a substantially linear path extending parallel to the central support member of the bow 11. Of course, the notches 23 may be formed to have a variety of different sizes and located at various positions along the base section 21, as is obvious to a person of ordinary skill in the art. The recessed notches 23 are generally U-shaped and define a lower arcuate surface such that the projectiles 13 can maintain continuous surface area contact when positioned within the recessed notches 23 respectively. This feature assists in keeping the projectiles 13 static during operating and non-operating conditions, which advantageously prevents damage to the shafts 14 thereof, thus ensuring proper functioning of the projectiles 13.

Referring to FIGS. 1 through 4, the assembly 10 further includes a plurality of articulated locking arms 24 having opposed end portions 25A, 25B pivotally connected to the base section 21 and freely movable along a plurality of arcuate paths defined about an associated perimeter of each of the recessed notches 23.

Referring to FIGS. 2 and 3, each locking arm 24 is provided with an arcuate inner edge 26 removably engageable with the projectiles 13 such that the user may resiliently bias a selected one of the locking arms 24 and independently remove an associated one of the projectiles 13 while remaining ones of the locking arms 24 and respective projectiles 13 are maintained at a static position. Such locking arms 24 are formed from non-skid rubber material for advantageously maintaining effective surface area contact with the projectiles 13 during non-operating conditions. Of course, alternate suitable materials may be used for the construction of the locking arms 24, as is obvious to a person of ordinary skill in the art.

One end portion 25B of each of the locking arms 24 defines a finger having an enlarged diameter passing over an associated one of the recessed notches 23 for advantageously assisting to maintain the projectiles 13 at a substantially stable position during non-operating conditions. The pivotal nature and arcuate shape of the locking arms 24, and the U-shape of the notches 23 advantageously allow a diameter of the notches 23 to be altered, thus enabling the notches 23 to hold arrows and bolts of various diameters.

Figure 4:
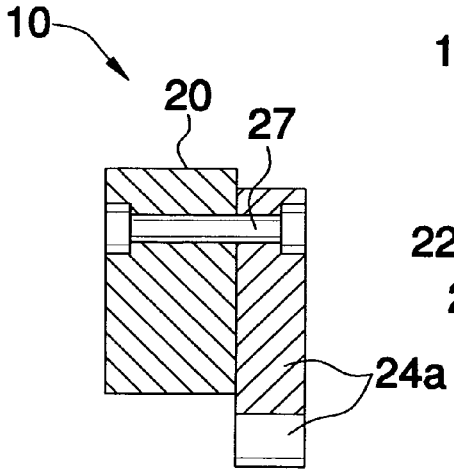
FIG. 4 is a cross-sectional view of the assembly shown in FIG. 3, taken along line 3—3 and showing the pin member passing therethrough.

Referring to FIG. 4, the locking arms 24 are positioned distal to the base section 21 for conveniently assisting the user to effectively manipulate the locking arms 24 between open and locked positions while maintaining the bow 11 at a cocked position. Each of the locking arms 24 further includes a pin member 27 securely passed therethrough and welded with the base section 21. Such a pin member 27 advantageously allows a user to silently manipulate the locking arms 24. As a result, the projectiles 13 can be removed from the notches 23 and loaded onto the central support member 12 without alerting a possible target.

Referring to FIGS. 1 and 2, a first set of the locking arms 24A are situated on a right side of the central support member 12 and a second set of the locking arms 24B are situated on a left side of the central support member 12 such that the first 24A and second 24B locking arm sets are equidistantly offset from the central support locking member 12. Such a first set of locking arms 24A are pivotal along a counterclockwise position from a locked position and the second set of locking arms 24B are pivotal along a clockwise position from a locked position associated therewith.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A bow-mountable assembly for assisting a user to maintain a plurality of projectiles at a fixed relationship with the bow during non operating conditions, said assembly comprising:

a quiver lock comprising an elongated base section having a rectilinear shape and a centrally disposed longitudinal axis extending substantially orthogonal to a longitudinal length of the bow, said base section further having oppositely disposed end portions laterally spaced from a centrally situated support member of the bow, said base section being aligned subjacent the central support member such that the user can maintain an unobstructed line of sight during operating conditions, said base section being provided with a plurality of juxtaposed recessed notches spaced along the longitudinal length thereof, said recessed notches being sized and shaped for receiving and effectively maintaining the projectiles along a substantially linear path extending parallel to the central support member of the bow; and a plurality of articulated locking arms having opposed end portions pivotally connected to said base section and freely movable along a plurality of arcuate paths defined about an associated perimeter of each said recessed notch;

wherein each said locking arm is provided with an arcuate inner edge removably engageable with the projectiles such that the user may resiliently bias a selected one of said locking arms and independently remove an associated one of the projectiles while remaining ones of said locking arms and respective projectiles are maintained at a static position.

2. The assembly of claim 1, wherein each said locking arm includes a pin member securely passed therethrough and welded with said base section.

3. The assembly of claim 1, wherein said recessed notches are generally U-shaped and define a lower arcuate surface such that the projectiles can maintain continuous surface area contact when positioned within said recessed notches respectively.

4. The assembly of claim 1, wherein a first set of said locking arms are situated on a right side of the central support member and a second set of said locking arms are situated on a left side of said central support member such that said first and second locking arm sets are equidistantly offset from the central support locking member.

5. The assembly of claim 4, wherein said first set of locking arms are pivotal along a counterclockwise position from a locked position and said second set of locking arms are pivotal along a clockwise position from a locked position associated therewith.

6. The assembly of claim 1, wherein one said end portion of each said locking arms defines a finger having an enlarged diameter passing over an associated one of said recessed notches for assisting to maintain the projectiles at a substantially stable position during non operating conditions.

7. A bow-mountable assembly for assisting a user to maintain a plurality of projectiles at a fixed relationship with the bow during non operating conditions, said assembly comprising:

a quiver lock comprising an elongated base section having a rectilinear shape and a centrally disposed longitudinal axis extending substantially orthogonal to a longitudinal length of the bow, said base section further having oppositely disposed end portions laterally spaced from a centrally situated support member of the bow, said base section being aligned subjacent the central support member such that the user can maintain an unobstructed line of sight during operating conditions, said base section being provided with a plurality of juxtaposed recessed notches spaced along the longitudinal length thereof, said recessed notches being sized and shaped for receiving and effectively maintaining the projectiles along a substantially linear path extending parallel to the central support member of the bow; and a plurality of articulated locking arms having opposed end portions pivotally connected to said base section and freely movable along a plurality of arcuate paths defined about an associated perimeter of each said recessed notch;

wherein each said locking arm is provided with an arcuate inner edge removably engageable with the projectiles such that the user may resiliently bias a selected one of said locking arms and independently remove an associated one of the projectiles while remaining ones of said locking arms and respective projectiles are maintained at a static position, said locking arms being formed from non-skid rubber material for maintaining effective surface area contact with the projectiles during non operating conditions.

8. The assembly of claim 7, wherein each said locking arm includes a pin member securely passed therethrough and welded with said base section.

9. The assembly of claim 7, wherein said recessed notches are generally U-shaped and define a lower arcuate surface such that the projectiles can maintain continuous surface area contact when positioned within said recessed notches respectively.

10. The assembly of claim 7, wherein a first set of said locking arms are situated on a right side of the central support member and a second set of said locking arms are situated on a left side of said central support member such that said first and second locking arm sets are equidistantly offset from the central support locking member.

11. The assembly of claim 10, wherein said first set of locking arms are pivotal along a counterclockwise position from a locked position and said second set of locking arms are pivotal along a clockwise position from a locked position associated therewith.

12. The assembly of claim 7, wherein one said end portion of each said locking arms defines a finger having an enlarged diameter passing over an associated one of said recessed notches for assisting to maintain the projectiles at a substantially stable position during non operating conditions.

13. A bow-mountable assembly for assisting a user to maintain a plurality of projectiles at a fixed relationship with the bow during non operating conditions, said assembly comprising:

a quiver lock comprising an elongated base section having a rectilinear shape and a centrally disposed longitudinal axis extending substantially orthogonal to a longitudinal length of the bow, said base section further having oppositely disposed end portions laterally spaced from a centrally situated support member of the bow, said base section being aligned subjacent the central support member such that the user can maintain an unobstructed line of sight during operating conditions, said base section being provided with a plurality of juxtaposed recessed notches spaced along the longitudinal length thereof, said recessed notches being sized and shaped for receiving and effectively maintaining the projectiles along a substantially linear path extending parallel to the central support member of the bow; and a plurality of articulated locking arms having opposed end portions pivotally connected to said base section and freely movable along a plurality of arcuate paths defined about an associated perimeter of each said recessed notch;

wherein each said locking arm is provided with an arcuate inner edge removably engageable with the projectiles such that the user may resiliently bias a selected one of said locking arms and independently remove an associated one of the projectiles while remaining ones of said locking arms and respective projectiles are maintained at a static position, said locking arms being formed from non-skid rubber material for maintaining effective surface area contact with the projectiles during non operating conditions, said locking arms being positioned distal to said base section for assisting the user to effectively manipulate said locking arms between open and locked positions while maintaining the bow at a cocked position.

14. The assembly of claim 13, wherein each said locking arm includes a pin member securely passed therethrough and welded with said base section.

15. The assembly of claim 13, wherein said recessed notches are generally U-shaped and define a lower arcuate surface such that the projectiles can maintain continuous surface area contact when positioned within said recessed notches respectively.

16. The assembly of claim 13, wherein a first set of said locking arms are situated on a right side of the central support member and a second set of said locking arms are situated on a left side of said central support member such that said first and second locking arm sets are equidistantly offset from the central support locking member.

17. The assembly of claim 16, wherein said first set of locking arms are pivotal along a counterclockwise position from a locked position and said second set of locking arms are pivotal along a clockwise position from a locked position associated therewith.

18. The assembly of claim 13, wherein one said end portion of each said locking arms defines a finger having an enlarged diameter passing over an associated one of said recessed notches for assisting to maintain the projectiles at a substantially stable position during non operating conditions.

* * * * *